United States Patent [19]

Bert et al.

[11] Patent Number: 4,460,895

[45] Date of Patent: Jul. 17, 1984

[54] INTEGRATED ERECTABLE ANTENNA SYSTEM

[75] Inventors: Joseph E. Bert, Fremont; Robert W. Cotterman, Sunnyvale, both of Calif.

[73] Assignee: GTE Products Corporation, Stamford, Conn.

[21] Appl. No.: 387,575

[22] Filed: Jun. 10, 1982

[51] Int. Cl.[3] ..... H01Q 1/08; H01Q 1/32

[52] U.S. Cl. ..... 343/713; 343/792.5; 343/881

[58] Field of Search ..... 343/711, 712, 713, 715, 343/812, 792.5, 880, 881, 882

[56] References Cited

U.S. PATENT DOCUMENTS

| | | | |
|---|---|---|---|
| 2,632,850 | 3/1953 | Anderson | 343/880 |
| 3,158,866 | 11/1964 | Powers | 343/882 |
| 4,028,709 | 6/1977 | Berkowitz et al. | 343/894 |
| 4,185,288 | 1/1980 | Dosch et al. | 343/713 |

*Primary Examiner*—Eli Lieberman

*Attorney, Agent, or Firm*—John F. Lawler

[57] ABSTRACT

An integrated erectable antenna system comprises a mast pivotally mounted for rotation between a horizontal stowed position and a vertical operative position, and a log-periodic antenna assembly longitudinally slidably and pivotally mounted on the mast for movement between stowed and operative positions. The pivoted end of the mast has an extendible arm connected by cable to a hand operated winch. The antenna assembly comprises an elongated boom having many articulated transverse dipoles connected thereto over its length and foldable for stowing without disconnecting the dipole parts. The boom is hinged to the mast about one axis transverse to the latter for pivoting from a stowed position parallel to the mast to an operative position perpendicular to the mast and about another axis parallel to the boom for orienting the dipoles in either horizontal or vertical planes when the mast is in the vertical position. The entire system may be mounted on a standard size military passenger vehicle ("Jeep"), is collapsible into a space approximating the length and width of the vehicle, and is erectable to the fully operative position by one operator in less than five (5) minutes and by two operators in less than three (3) minutes.

The invention also contemplates the method of erecting this antenna system consisting of the steps extending a lever arm from the pivoted end of the mast, sliding the antenna assembly from mid-mast to the other mast end, extending the folded dipoles to full length, and pivoting the antenna assembly into the operative position perpendicular to the mast while pivoting the mast from horizontal to vertical positions by winding on a winch reel a cable attached to the lever arm.

19 Claims, 13 Drawing Figures

INTEGRATED ERECTABLE ANTENNA SYSTEM

RELATED APPLICATION

Ser. No. 387576, filed June 10, 1982.

BACKGROUND OF THE INVENTION

This invention relates to antennas and more particularly to an improved integrated erectable antenna system.

The use of communications and other electronic equipment in the field often requires the positioning of a log-periodic antenna at heights of 18 feet or more above the ground in order to prevent ground interference with signals being radiated or received by the antenna. In the case of portable tactical military systems it is essential that such an antenna be elevated from a stowed position on the transporting vehicle to the operative position quickly and with a minimum of personnel, ideally one person. In addition, the antenna and its support in the stowed position on the vehicle should be sufficiently compact as to not interfere with mobility of the vehicle in the field or on heavily trafficked roads.

An erectable log-periodic antenna system of the general type mentioned above has been built in the past but has several disadvantages. The antenna boom comprises three separate pieces. The many radiating elements are removably secured to the boom and are bundled together for stowing. The mast has several separate sections which are coupled together and the antenna is mounted on top of the mast after the latter has been raised to the vertical position. The disadvantages of this system are excessive assembly time, the large number of separate pieces and the complex assembly procedure leads to loss of parts and unreliability, difficulty of assembly especially in snow and mud, at least two operators are required to assemble and disassemble the system, and assembly of the system requires a large amount of open space around the supporting vehicle.

This invention is directed to an improved antenna system of this type.

OBJECTS AND SUMMARY OF THE INVENTION

A general object of the invention is the provision of a portable erectable antenna system which is integrated, that is, substantially all parts of the system are connected together at all times.

Another object is the provision of a portable erectable antenna system which may be changed from the stowed to operative positions by one operator in less than five minutes.

A further object is the provision of such an antenna system which is rugged, light weight and economical to produce.

These and other objects of the invention are achieved with a portable integrated erectable antenna system having a mast pivoted at one end on a support post and an antenna assembly pivotally supported on the other end of the mast, both the mast and antenna assembly being rotatable from compact parallel positions when stowed at a low level to perpendicular operative positions when the mast is vertical. The antenna assembly includes a boom having permanently connected articulated radiating elements which are manually foldable from the extended operative positions perpendicular to the boom to stowed positions parallel to the boom. The entire system may be carried on a standard military passenger vehicle and erected and stowed by one operator.

DESCRIPTION OF PREFERRED EMBODIMENTS

Figure 1:
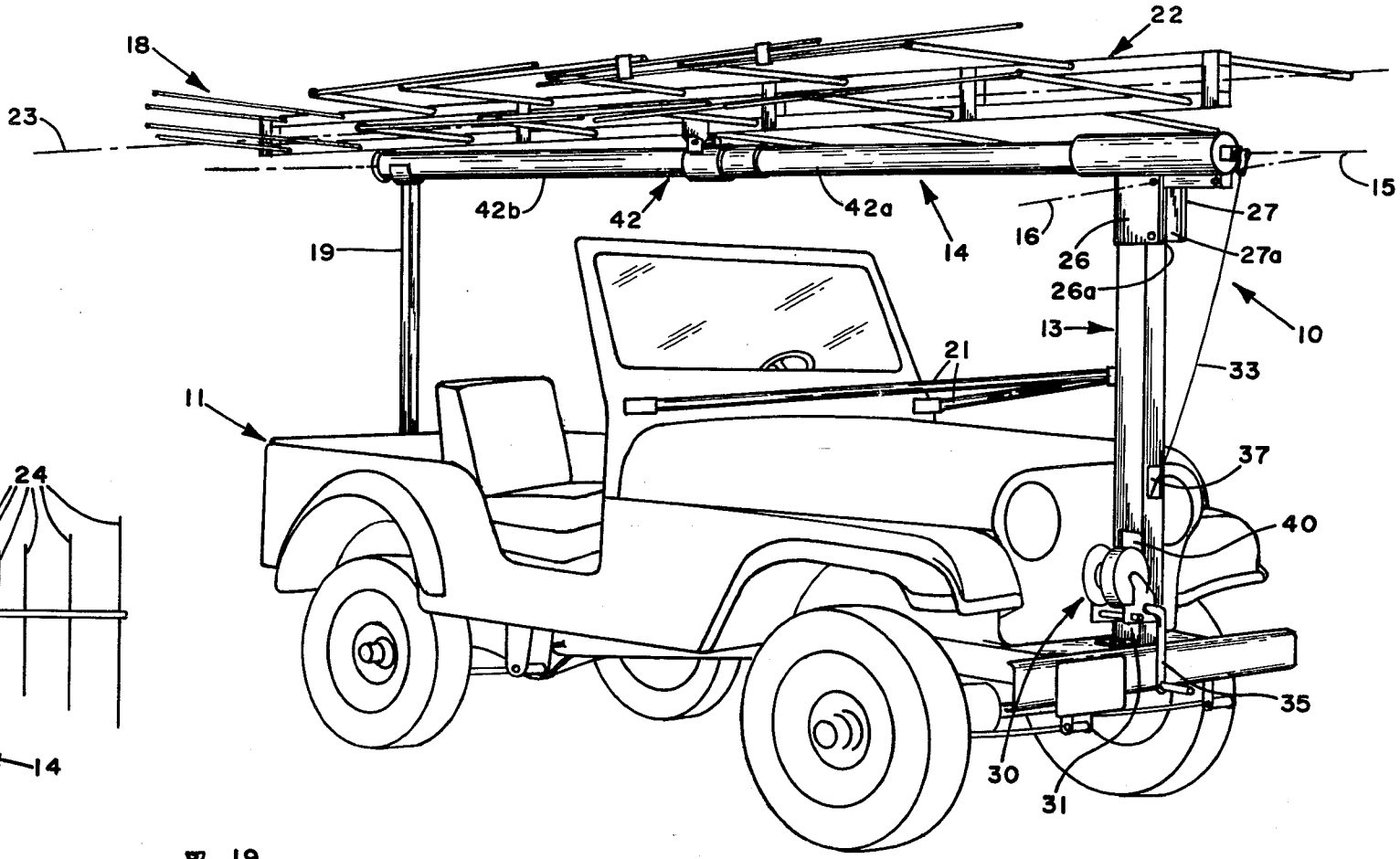
FIG. 1 is a perspective view of an antenna system embodying the invention mounted on a standard military vehicle and shown in the stowed position.
Figure 2:
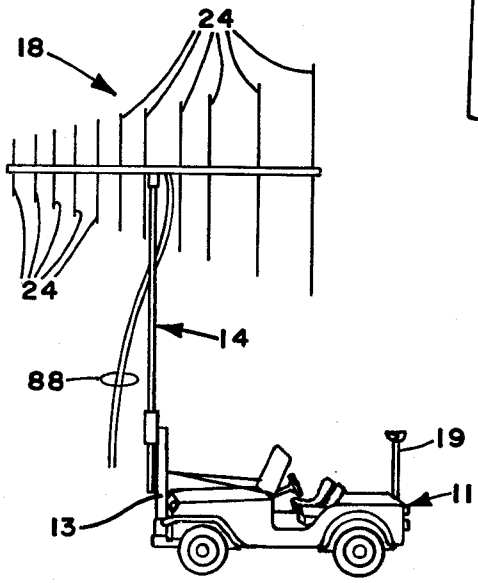
FIG. 2 is a perspective view of the vehicle-mounted antenna system shown in the operative position.

Referring now to the drawings, a preferred embodiment of the invention is shown in FIGS. 1 and 2 as an antenna system 10 mounted on a vehicle 11 in an inoperative or stowed position (FIG. 1) and in an operative position (FIG. 2). The system 10 comprises a vertical post 13 supported on a platform comprising the front portion of the vehicle frame, a mast 14 having a longitudinal axis 15 and pivotally connected to post 13 for rotation about axis 16, and an antenna assembly 18 supported on mast 14. A vertical brace 19 secured to the rear frame of the vehicle 11 supports the opposite or free end of mast 14 in the horizontal or stowed position as shown in FIG. 1. Rods 21 connected to the vehicle body and the central part of post 13 reinforce the latter.

Figure 6:
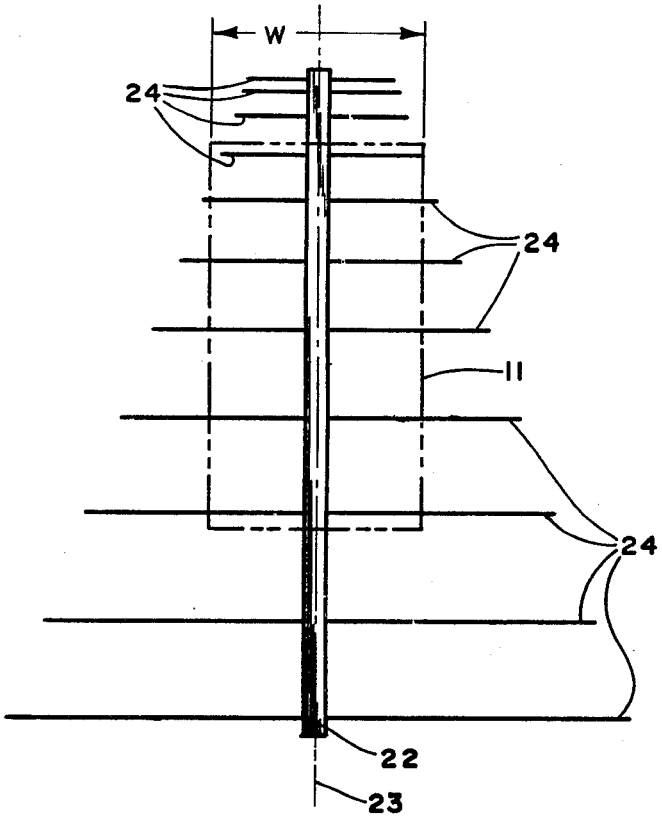
FIG. 6 is a plan schematic view of the log-periodic antenna of this invention showing the radiating elements in their operative or extended positions.

Antenna assembly 18 has a boom 22 with a longitudinal axis 23 and to which a plurality of longitudinally spaced dipoles 24 are connected, see FIGS. 2 and 6. The antenna may, by way of example, comprise a log-periodic structure as shown. A log-periodic antenna used in an embodiment of this invention had a boom 13 feet long with 14 dipoles (28 elements) having lengths ranging from 157 inches at the low frequency (20 MHz) and 49 inches at the high frequency (80 MHz) end. This antenna was mounted on a mast 12 feet in length pivoted on a post extending 6 feet above the ground.

Post 13 preferably is a square tubular preferably steel structure bolted at its bottom end to the front frame of vehicle 11. Plates 26 and 27 are fastened as by welding or bolting to opposite sides of post 13 at its upper end and having projecting portions 26*a* and 27*a* which extend forwardly from the post.

Figures 3, 3A, 4, 5:
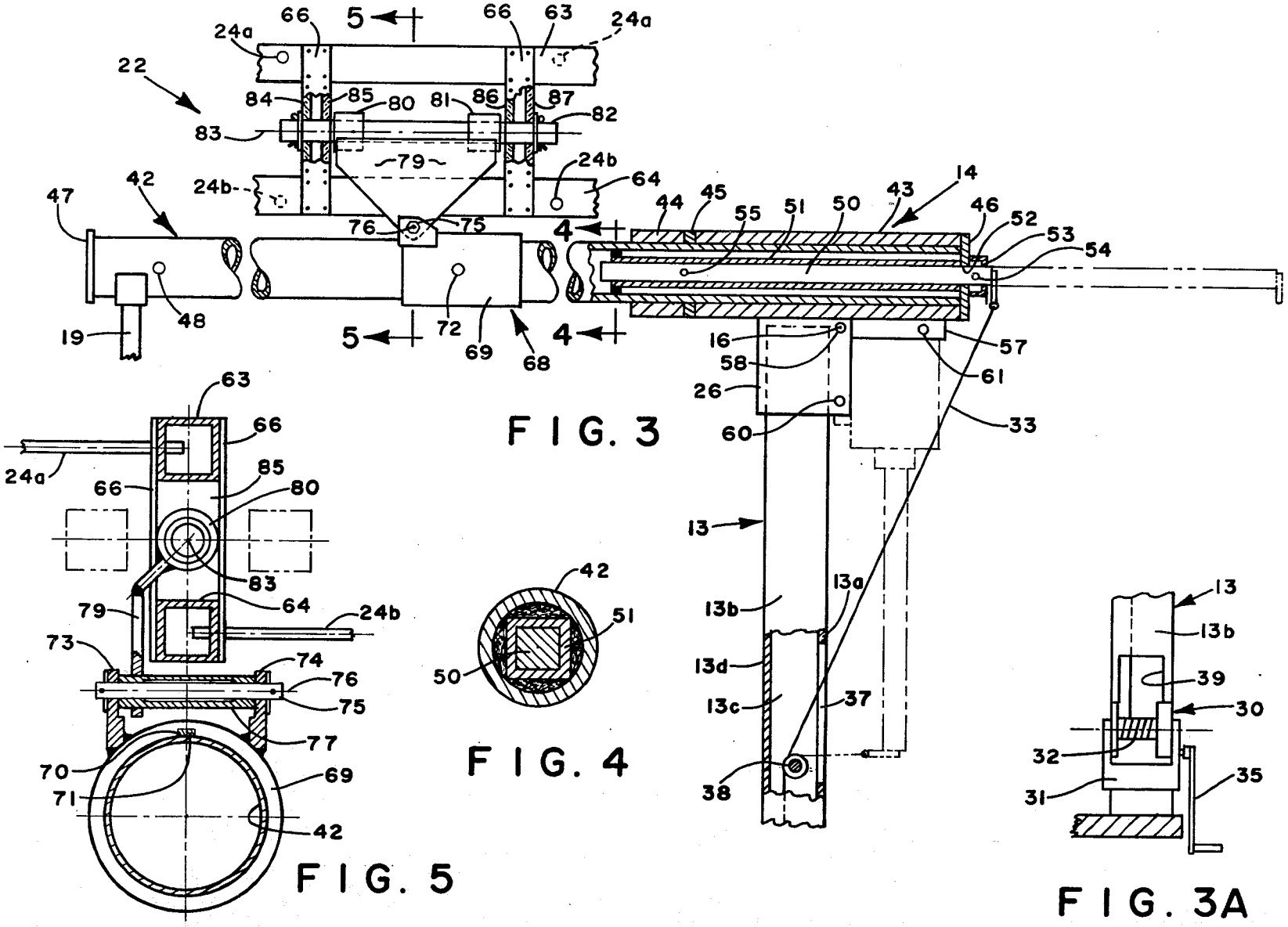
FIGS. 3 and 3A are fragmentary elevations of the antenna system partly in section showing details of construction.
FIG. 4 is an enlarged transverse section taken on lines 4—4 of FIG. 3.
FIG. 5 is an enlarged transverse section taken on line 5—5 of FIG. 3.

A winch 30, see FIGS. 1 and 3A, is secured by a bracket 31 to the lower part of post 13 and has a reel 32 on which a cable 33 is wound. Winch 30 is operated by a hand crank 35. Cable 33 is connected at its upper end to the pivoted end of mast 14 and extends downwardly through an opening 37 in front wall 13*a* of the post, over a sheave 38 journalled on sidewalls 13*b* and 13*c* of the post, over a similar sheave, not shown, adjacent to winch reel 32 and journalled on front wall 13*a* and back wall 13*d* of the post, and out through opening 39 in side wall 13*c* to reel 32.

Mast 14, see FIG. 1, comprises an elongated tube 42 with the lower approximately one-half portion 42*a* preferably made of a light weight metal such as an aluminum alloy and the upper approximately one-half portion 42*b* preferably made of an electrical insulating material such as fiberglass, a base sleeve 43 surrounding the right end (as viewed in FIG. 3) of tube 42, a thrust collar 44 permanently secured to the outside of tube 42, and a thrust washer 45 which engages adjacent ends of sleeve 43 and collar 44. A cover plate 46 is fastened to the end of tube 42 and overlies the end of and is movable relative to sleeve 43. The opposite end of tube 42 has a stop plate 47 secured thereto.

In order to facilitate pivoting of mast 14 between the horizontal or stowed and the vertical or operative positions, an extendible lever arm 50 is disposed coaxially within mast tube 42 and sleeve 43 when retracted as shown in solid lines in FIG. 3, and projects outwardly from the mast end in the extended or operative position as shown in broken lines. Arm 50 preferably is a square bar, see FIG. 4, and is longitudinally slidably movable within a correspondingly shaped liner 51 in mast tube 42 and in an opening 52 in plate 46. Liner 51 is secured to the cylindrical tube 42 as by welding or other suitable means. With this arrangement, torque applied to lever arm 50 in the extended position and with the mast in the operative position shown in FIG. 2 rotates tube 42 about mast axis 15 relative to base sleeve 43. A lock clip 53 secured to the outside of cover plate 46 engages a lock pin, not shown, when the latter is inserted in openings 54 and 55 in arm 50 to lock the arm in the retracted or extended positions, respectively.

Base sleeve 43 has a rib 57 welded or otherwise secured to its lower and pivotally connected by bolt 58 through openings, now shown, in the upper portions of post plates 26 and 27 along pivotal axis 16. When the mast is in the stowed position, base sleeve 43 engages the tops of post plates 26 and 27. When the mast is in the operative position, sleeve 43 engages the front edges of plates 26 and 27 as shown in broken lines in FIG. 3. The mast is locked in the operative position by a pin not shown which extends through aligned openings 60 and 61 in plates 26, 17 and rib 57, respectively.

Boom 22 of antenna assembly 18 comprises elongated coextensive parallel conductive preferably square tubes 63 and 64, see FIGS. 3 and 5, secured in spaced relation by a plurality of longitudinally spaced nonconductive straps 66 riveted to opposite sides of the tubes throughout their lengths. Each dipole has two elements 24*a* and 24*b* connected to and projecting in opposite directions from conductive tubes 63 and 64, respectively, with the elements of longitudinally adjacent dipoles connected to the same conductive tube projecting in opposite directions. The purpose of this arrangement is to provide a 180 degree phase change in the feed to adjacent dipoles as is a well-known requirement for end fire radiation of a log-periodic antenna. Tubes 63 and 64, in addition to mechanically supporting the dipole elements, are electrical feed conductors for these elements. The antenna is energized by balanced feed lines, not shown, connected to the ends of tubes 63 and 64, respectively, adjacent the smallest dipole, i.e., the left end as viewed in FIG. 2.

Boom 22 is supported on mast tube 42 by a hinge mechanism 68 comprising a sleeve 69 slidably mounted on tube 42 and having a keyway 70 engagable with key 71 on top of mast tube 42 as viewed in FIG. 5. A hinge support is permanently secured to sleeve 69 and consists of laterally spaced outwardly extending apertured plates 73 and 74 which support pivot pin 75 along axis 76. A bearing sleeve 77 is pivotally supported on pin 75 for rotation about pin axis 76 which is perpendicular to a vertical plane containing mast axis 15.

Boom 22 is supported on bearing sleeve 77 by an upwardly extending longitudinally diverging inwardly inclined strut 79 connected at upper opposite longitudinal ends to pivot sleeves 80 and 81. A pivot tube 82 having an axis 83 extends through and is supported in sleeves 80 and 81 and projects from opposite ends thereof. Adjacent boom straps 66 have transverse nonconductive support strips 84, 85, 86 and 87 riveted thereto as shown and apertured to receive the projecting ends ot tube 82 for supporting the boom thereon. Axis 83 of pivot tube 82 is parallel to mast axis 15 when the mast is horizontal and is perpendicular to axis 16 when the mast is vertical. Axis 83 is the second pivotal axis about which boom 22 is rotatable to position dipoles 24 in the horizontal plane shown in FIGS. 3 and 5 and the vertical plane as shown in FIG. 2 and in broken lines in FIG. 5.

In order to insure that boom 22 normally is oriented about axis 83 so that dipoles are parallel to the horizontal plane, the center of gravity of the boom is offset from axis 83 to cause the boom to rotate to the position shown in FIG. 5. This is achieved, for example, by offsetting pivot axis 82 above the midpoint between tubes 63 and 64. Boom 22 thus rotates by gravity from its stowed position generally parallel to mast 14 to its operarive position perpendicular to the mast and remains in the latter position when mast tube 42 is rotated in azimuth. If desired, boom 22 may be positively locked in the operative position by suitable means such as a locking pin or the like prior to elevation of the mast to its operative position. The polarization of the antenna is changed from horizontal to vertical by manually rotating the boom about axis 83 to the position shown in broken lines in FIG. 5 by means of cords 88, see FIG. 2, attached to the boom and actuated by the operator.

Figure 7:
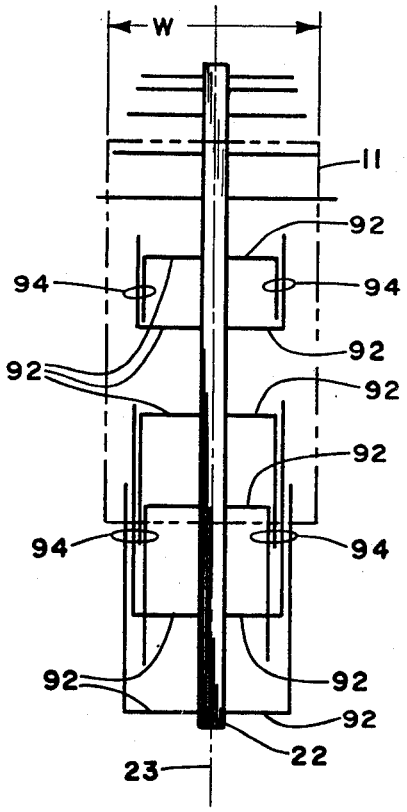
FIG. 7 is a view similar to FIG. 6 showing the radiating elements in collapsed or stowed position.
Figure 8:
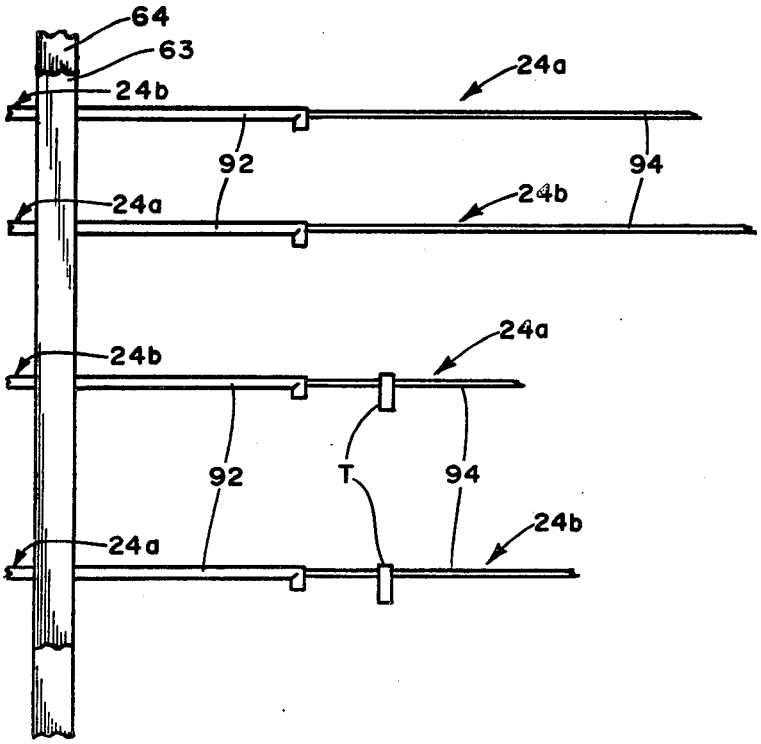
FIGS. 8 and 9 are fragmentary views of the antenna showing radiating elements in the operative and stowed positions, respectively.
Figure 9:
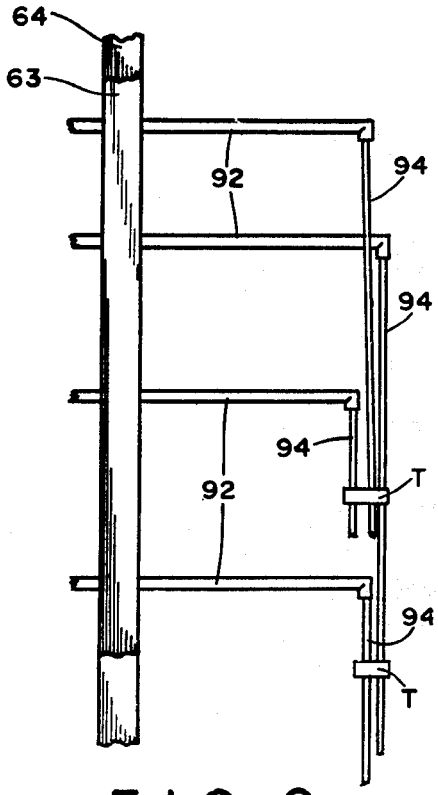

Dipoles 24 of the log-periodic antenna have lengths which vary from a maximum at the lower frequency end of the antenna to a minimum at the high frequency end, the lengths of many of the dipoles being substantially greater than the width W of vehicle 11, see FIG. 6. In order to reduce the lengths of these dipoles when the antenna is in the stowed position, each element 24*a* or 24*b* of the longer dipoles is articulated. Each of such elements is structurally the same (except for length) and comprises an inner section 92 secured to one of conductive tubes 63 or 64, and an outer section 94 hinged to the outer end of inner section 92 for pivotal movement between the fully extended position shown in FIGS. 6 and 8 and the folded or collapsed position shown in FIGS. 7 and 9. Certain of the outer sections 94 of the elements are fitted with self-adhesive ties T which enable overlapping outer sections to be releasably secured or bundled together in the folded position, see FIG. 9. An example of the self-adhesive tie T useful in the practice of the invention is the commerically available product sold under the trademark "Velcro" by Velcro U.S.A., Talon American, Stamford, Conn.

Figure 10:
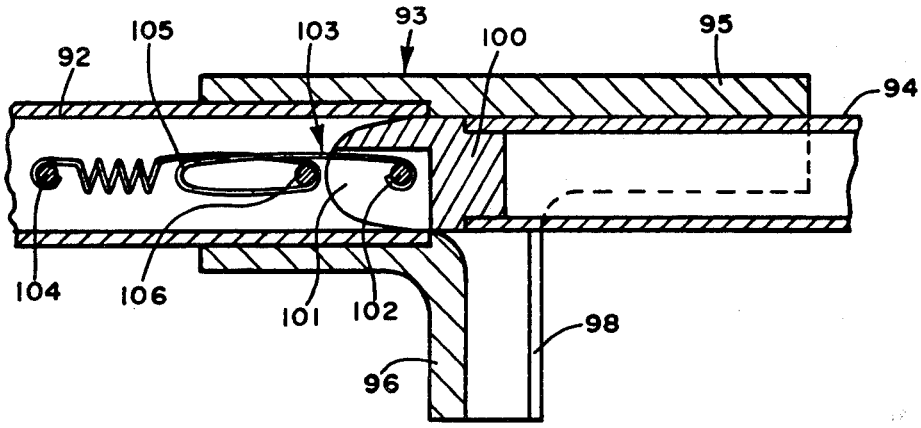
FIG. 10 is a fragmentary side elevation partly in section of a radiating element embodying the invention in the extended or operative position.
Figure 11:
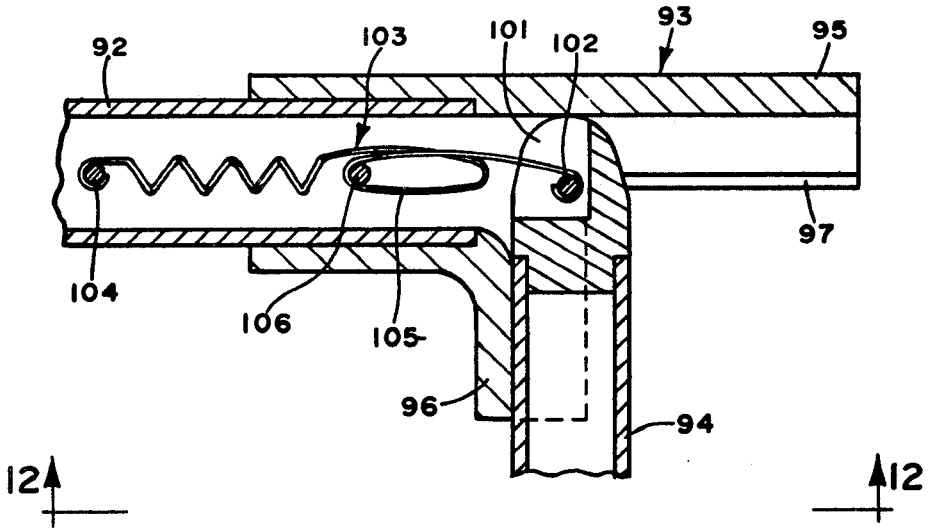
FIG. 11 is a view similar to FIG. 10 showing the radiating element in the stowed position.
Figure 12:
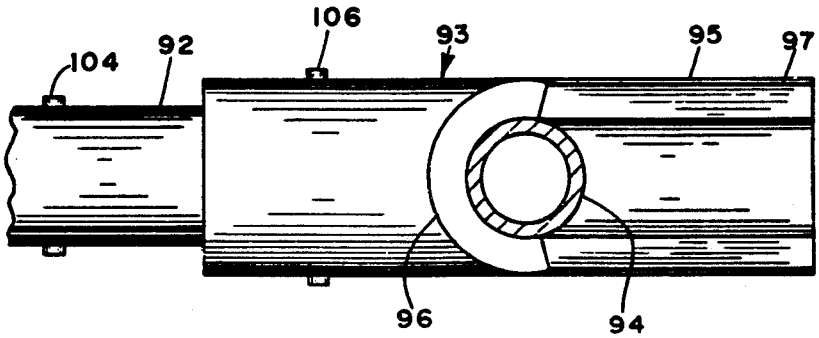
FIG. 12 is a view taken on line 12—12 of FIG. 11.

A preferred construction of the two-piece element 24*a* constituting one-half of the foldable dipole is shown in FIGS. 10, 11, and 12, and comprises the conductive cylindrical tubular inner section 92 secured to boom tube 63, a T-shaped conductive sleeve 93 telescoped over and secured to the outer end of section 92, and a cylindrical conductive outer section 94. Sleeve 93 has an outer longitudinal leg 95 and a transverse leg 96, the inside diameters of the legs being equal to the outside diameter of outer section 94. The walls of sleeve legs 95 and 96 have intersecting slots 97 and 98, respectively, each slot preferably having a width slightly less than 180 degrees.

Outer section 94 has a rounded tapered electrically conductive plug 100 secured to its inner end and adpated to fit snugly within the adjacent end of inner section 92. Plug 100 is formed with a longitudinal slot or recess 101 and has a pin 102 secured thereto and extending transversely through slot 101. Outer section 94 is releasably connected to inner section 92 by a spring clip 103 anchored at its inner end to transverse pin 104 secured to section 92 and at its outer end to pin 102. Clip 103 is configured with a longitudinally elongated loop 105 through which extends a transverse guide pin 106 secured to section 92. Clip 103 is in tension at all times and holds plug 100 of outer section 94 tightly within inner section 92 when the outer section is in the extended or operative position as shown in FIG. 10. When it is desired to move outer section 94 from the extended position to the folded position (FIG. 11), outer section 94 is pulled outwardly from inner section 92 and thereafter pivoted (clockwise as viewed) into engagement with sleeve leg 96. Because slots 97 and 98 in the legs are less than 180° wide, outer section 94 is releasably clamped by the legs in both the extended and folded positions so as to eliminate play and to provide additional mechanical support to outer section 92 when in the extended position. Loop 105 in spring clip 103 also insures limited withdrawal of outer section 94 from inner section 92 to prevent damage to the spring. With this construction, outer section 94 is quickly and conveniently pivoted between extended and folded positions without disengaging the parts.

The method of raising the antenna system from the stowed to operative positions is now described. With the antenna system in the stowed position as shown in FIG. 1, mast 14 is horizontal with mast tube 42 resting on post 13 and brace 19, antenna assembly 18 is approximately symmetrically positioned on mast 14 with the dipole elements folded and tied together, and lever arm 50 is fully retracted within the base of the mast. The operator fully extends lever arm 50 to the dotted line position shown in FIG. 3 and locks it in place with a locking pin through arm opening 55. The folded dipole elements are then untied by opening ties T and the outer section 94 of each element is pivoted to the fully extended position. The entire antenna assembly is moved longitudinally on the mast with sleeve 69 of the antenna assembly hinge mechanism sliding on mast tube 42 toward plate 47. Winch 30 is cranked to wind cable 33 on reel 32 and cause mast 14 to pivot relative to post 13 about axis 16 until mast tube 42 is elevated slightly above brace 19. The operator then moves the antenna assembly to the end of mast tube 42 with hinge sleeve 69 abutting against stop 47 and inserts a lock pin through opening 72 in sleeve 69 and opening 48 in tube 42 to lock antenna assembly at the end of the tube. In this position, boom 22 overhangs the end of mast tube 42 and because the center of gravity of boom 22 is offset from transverse pivotal axis 76, the boom rotates by gravity in a counter-clockwise direction as viewed in FIG. 3. Cranking of winch 30 continues until mast 14 is in the vertical position, boom 22 having rotated by gravity to the horizontal position at the top of the elevated mast. A bolt is then inserted through openings 60 in post plates 26 and 27 and opening 61 in mast rib 57 to lock the mast in the vertical operative position.

In order to rotate antenna assembly 18 in azimuth for selecting the direction of transmission or reception by the antenna, the lower end of the now vertically extending lever arm 50 is rotated which causes mast 42 to be rotated by liner 51. The load is carried by post 13, base sleeve 43 and thrust sleeve 44.

As mentioned above, the center gravity of boom 22 is offset from pivot axis 83, see FIG. 3, of the assembly so that the latter rotates by gravity to the position in which the dipoles 24 are normally in a horizontal plane, i.e., the antenna is horizontally polarized. As mentioned above, the boom may be positively locked in this operative position if desired. In order to provide vertically polarized transmission and reception by the antenna, a pair of control cords 88, see FIG. 2, fastened to boom 22 and extending to the ground permit the operator to rotate the boom manually about axis 83 and lock it in that position to achieve the desired vertical polarization.

In order to collapse the antenna to the stowed position the foregoing steps are followed in reverse order.

Apparatus such as transmitter or receiving equipment carried in vehicle 11 is connected by conductors, not shown, preferably two balanced feed lines, to tubes 63 and 64, respectively, of boom 22 at the high frequency end of the antenna.

What is claimed is:

1. An integrated erectable antenna system comprising a platform, a post secured to and extending vertically from said platform and having an upper end spaced a predetermined distance from said platform, a mast having first and second ends and being pivotally secured adjacent to the first end to said upper end of said post for movement between a horizontal stowed position and a vertical operative position, means for pivoting said mast between said horizontal and vertical positions, an antenna assembly slidably mounted on said mast between a stowed position substantially midway between said first and second ends thereof and an operative position at said second end, means to releasably lock said assembly in said stowed and operative positions, respectively, said assembly comprising an elongated boom and a hinge mechanism, said boom having a longitudinal axis and being pivotally connected to said hinge mechanism for rotation about first and second axes extending perpendicular and parallel, respectively, to said longitudinal axis of the boom, radiating means mounted on said boom, and means for electrically feeding said radiating means.

2. The system according to claim 1 in which said radiating means comprises a plurality of dipoles extending transversely of said longitudinal axis and having log-periodically varying lengths and longitudinal spacings, certain of said dipoles having two-piece collapsible elements, each of said elements having an inner section secured to said boom and an outer section hinged to said inner section and movable between an operative position extending colinearly with said inner section and a collapsed position transverse to said inner section.

3. The system according to claim 2 with means for releasably securing together said outer sections of adjacent elements in the collapsed position.

4. The system according to claim 3 in which said securing means constitutes self-adhesive strips.

5. The system according to claim 1 in which said pivoting means comprises a winch secured to said platform adjacent to said post and having a cable wound thereon, said cable being connected to said mast at a location spaced from the pivotal connection thereof to said post in the direction of said first end.

6. The system according to claim 5 with an elongated lever arm telescoped within and having an end projecting from said first end of the mast, said arm being movable between stowed and operative positions at minimum and maximum extensions, respectively, from said first end of the mast, said cable being connected to said projecting end of the arm.

7. The system according to claim 1 in which said mast is cylindrical and has a longitudinal axis and comprises an elongated tube and a sleeve around said tube adjacent said first end, said sleeve being pivotally connected to said post, said tube being rotatable about the mast axis relative to said sleeve.

8. The system according to claim 7 with thrust collar means secured to said tube and abutting said sleeve.

9. The system according to claim 7 with an elongated arm telescoped within and having an end projecting from said first end of said tube, said arm being movable between stowed and operative positions at minimum and maximum extensions, respectively, from said first end of the tube, said cable being connected to the projecting end of said arm, said arm being nonrotatably coupled to said tube whereby a torque applied to said arm causes said mast to be rotated about the mast axis.

10. The system according to claim 1 in which the center of gravity of said boom is offset from said first axis in the direction of said second end of said mast when the antenna assembly is in said stowed position whereby said boom rotates by gravity into perpendicularity with said mast when the boom is in said operative position.

11. The system according to claim 1 in which said radiating means comprises a plurality of longitudinally spaced generally parallel dipole elements, the center of gravity of said boom being offset from said second axis whereby said boom rotates by gravity about said second axis to a limit with said elements extending in directions parallel to said first axis.

12. An erectable antenna system comprising an elongated mast having a longitudinal axis and being pivotally supported at one end for movement between a horizontal stowed position and a vertical operative position, an antenna assembly slidably mounted on said mast between a stowed position symmetrical with said mast and an operative position at the other end of the mast opposite said one end, said assembly comprising an elongated boom and a plurality of longitudinally spaced dipoles connected to and extending transversely of said boom, said boom having a longitudinal axis and being pivotally connected to said mast for rotation about an axis transverse to said longitudinal axis whereby said boom is horizontal when said mast is in the stowed and operative positions, and means for electrically feeding said dipoles.

13. The system according to claim 12 in which said mast has a base portion at said one end and a tube portion between said base portion and said other end, said tube portion being connected to said base portion for rotation about said mast axis.

14. The system according to claim 12 with hinge means connecting said boom to said mast, said hinge means having said transverse axis and a second pivotal axis perpendicular to said transverse axis, said boom being pivotable about said second axis whereby said dipoles are horizontal when the mast is in the stowed position and are rotatable between horizontal and vertical positions when said mast is in the operative position.

15. The system according to claim 12 in which certain of each of said dipoles comprise a pair of two-piece collapsible elements, each of said elements having an inner section secured to said boom and an outer section hinged to said inner section and movable between an operative position colinear with the inner section and a collapsed position substantially parallel to the boom axis.

16. In an antenna system having an elongated mast with an antenna assembly supported on said mast, said assembly having an elongated boom and a plurality of foldable dipoles connected to said boom, a method of erecting said system from a stowed position with the mast horizontal and said boom parallel to said mast to an operative position with the mast vertical and said boom perpendicular to said mast, consisting of the steps of unfolding said dipoles to full operating lengths, moving said assembly from a position longitudinally symmetrical with said mast to a position at one end of the mast, and pivoting said mast about a horizontal axis at the other end thereof and simultaneously rotating said antenna assembly about a first axis perpendicular to said boom until said mast and said assembly are in said operative position with said dipoles horizontal.

17. The method according to claim 16 with the additional step or rotataing said assembly about a second axis parallel to said boom until said dipoles are vertical.

18. The method according to claim 16 with the additional step of rotating said mast about said mast axis when in the operative position.

19. The method according to claim 16 with the additional step of extending lever arm from said other end of the mast, said pivoting step consisting of applying a force on the outer end of said arm transversely of the mast axis.

* * * * *